US005499556A

United States Patent [19]

Exner et al.

[11] Patent Number: 5,499,556

[45] Date of Patent: Mar. 19, 1996

[54] PORTABLE ICE SKATE BLADE SHARPENER

[75] Inventors: Walter R. Exner, R.R. #1, Tappen, British Columbia, Canada, V0E 2X0; Vincent A. Exner, 8273 Copper Place, Mission, British Columbia, Canada, V2V 5X5; Urbin L. Foucher, 23177 - 129th Avenue, Maple Ridge, British Columbia, Canada, V2X 0M5

[73] Assignees: Walter R. Exner; Vincent A. Exner; Urbin L. Foucher, all of British Columbia, Canada

[21] Appl. No.: 418,675

[22] Filed: Apr. 7, 1995

[51] Int. Cl.[6] ..... B21K 17/00

[52] U.S. Cl. ..... 76/83; 76/82; 76/84; 451/558

[58] Field of Search ..... 76/82, 83, 82.1, 76/82.2, 84; 451/540, 557, 558; D8/91

[56] References Cited

U.S. PATENT DOCUMENTS

| | | | |
|---|---|---|---|
| 1,006,000 | 10/1911 | Oosdyke | 76/83 |
| 2,295,859 | 9/1942 | Murray | 451/558 |
| 2,542,472 | 2/1951 | Brinkley | 76/86 |
| 2,791,831 | 5/1957 | Hollis | 76/86 U X |
| 4,815,240 | 3/1989 | Larson | 51/205 WG |

FOREIGN PATENT DOCUMENTS

| | | | |
|---|---|---|---|
| 190414 | 6/1957 | Austria | 451/557 |
| 1254042 | 5/1989 | Luxembourg . | |

*Primary Examiner*—Douglas D. Watts
*Attorney, Agent, or Firm*—Cahill, Sutton & Thomas

[57] ABSTRACT

An ice skate blade sharpener having an elongate body with a first elongated slot along one side edge and a honing stone affixed to a bottom thereof, presenting a convex, elongated, outwardly facing surface. The side walls extending from the one side edge to another side edge of the body opposite the one side edge. The another side edge having a pair of elongated honing stones affixed to respective side walls with planar parallel surfaces spaced apart and defining a second elongated slot slightly wider than the thickness of a skate blade, such that upon squeezing said side walls together the second elongated slot is narrowed so as to cause deburring of a sharpened skate blade inserted into the second slot and moved along the length thereof.

12 Claims, 1 Drawing Sheet

PORTABLE ICE SKATE BLADE SHARPENER

FIELD

The present invention relates to a portable ice skate blade sharpener which can be carried on the person of a user.

BACKGROUND

Skate sharpening is normally accomplished with an apparatus that includes a narrow grinding wheel disposed with its axis vertical and its wheel horizontal. The ice skate to be sharpened is mounted in a clamp with its blade horizontal and positioned with the center of the blade at the same elevation as the center of the wheel. After being sharpened, an ice contacting surface of a blade is ideally concave when viewed in cross section. Any loss of integrity of this concave surface will drastically reduce the efficiency of the skate. Thus, if a skater happens to step on a small rock or hard protrusion, the blade could be damaged to an extent of requiring re-sharpening. One solution is to use a hand-held sharpener to dress the damaged blade.

Various hand-held ice skate blade sharpeners are known. U.S. Pat. No. 4,815,240 discloses a device that consists of a holder having a first elongated slot slightly larger than the width of a skate blade and a honing stone with a convex outer surface mounted in the bottom of the slot. On the opposite side is a second slot with a honing stone mounted against one wall leaving a width slightly greater than the width of a skate blade so that after sharpening the blade by running it along the stone in the first slot, the blade can be deburred by inserting it into the second slot and pressing the blade against the stone. The skate blade is then removed, the blade reversed and the process repeated. Because of the relatively small depth of the first slot, it is difficult to ensure that the blade is parallel to the sides of the first slot. Consequently, it is difficult to achieve accurate sharpening of the blade. Similarly, it is necessary for a user to gauge whether or not the blade is parallel to the stone surface in the second slot and to debur each side wall of the blade separately without abrading the bottom edges of the blade.

Accordingly, it is an object of the present invention to provide an improved portable skate blade sharpener. It is a further object of the invention to provide a skate blade sharpener which can debur both side walls of the blade simultaneously.

SUMMARY OF THE INVENTION

According to the invention there is provided an ice skate blade sharpener having an elongate body with a first elongated slot along one side edge and a honing stone affixed to a bottom thereof, presenting a convex, elongated, outwardly facing surface. The side walls extend from the one side edge to another side edge of the body opposite the one side edge. The another side edge has a pair of elongated honing stones affixed to respective side walls of the body with planar parallel surfaces spaced apart and defining a second elongated slot slightly wider than the thickness of a skate blade. Upon squeezing the side walls of the body together, the second elongated slot is narrowed so as to cause deburring of a sharpened skate blade inserted into the second slot and moved along the length thereof.

Advantageously, the side walls are cantilevered from the one side edge. Moreover, the first elongated slot may be slightly wider than the width of a skate blade.

Preferably, the edge walls joining the side walls to the first slot are inclined towards a bottom of the slot from respective ones of the side walls. A bottom of the first slot may be of circular cross section and snugly receive a honing stone also of circular cross section.

By making the elongate body from an extruded length of aluminum the cost of the sharpener may be substantially reduced from that which would result from molding or machining the body of each sharpener.

Preferably, the honing stone may be replaceable.

BRIEF DESCRIPTION OF THE DRAWINGS

The novel features believed to characterize the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
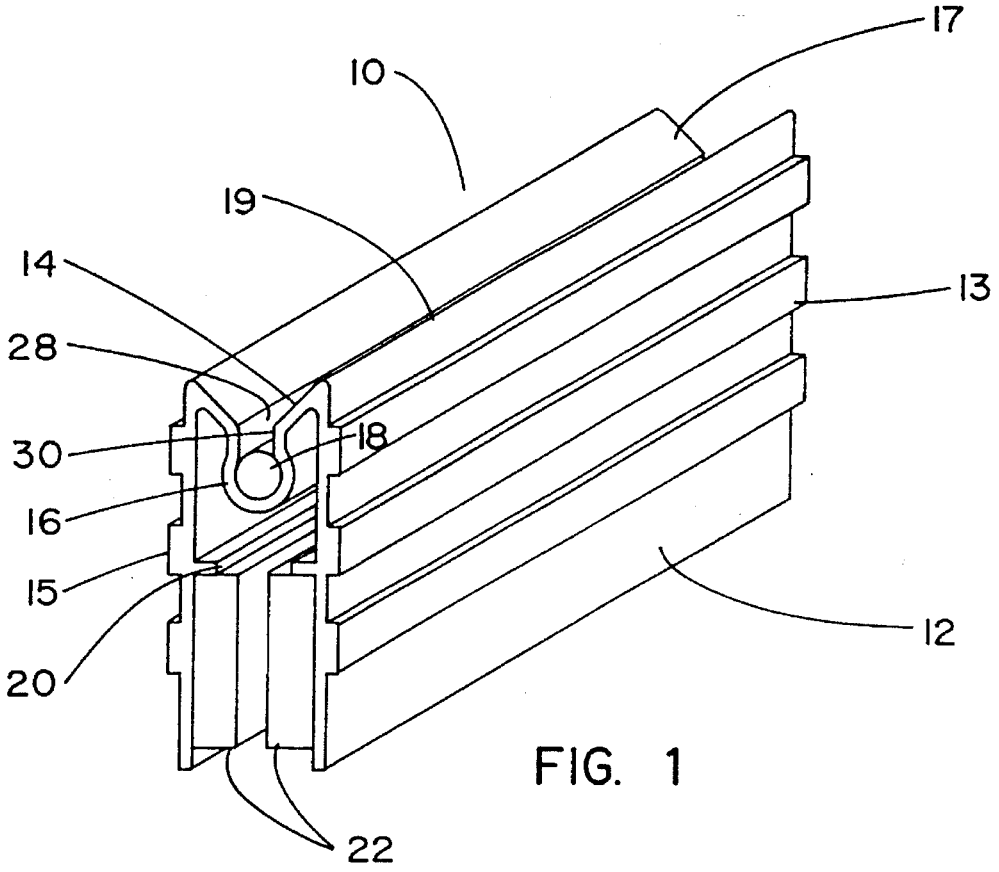
FIG. 1 is a perspective view of the sharpener.

Referring to FIG. 1, the skate blade sharpener 10 consists of a short length of extruded aluminum which functions as a holder 12. Typically the length of the extrusion is three inches. Holder 12 consists of two side walls 13 and 15 cantilevered about respective inclined walls 14 and 17. Inclined walls 14 and 17 are joined to respective parallel slot walls 28 and 30 of an elongated slot 19. Slot walls 28 and 30 join the wall of a circular bottom 16 which is affixed a honing stone 18 having a convex outer surface. The width of slot 19 is only slightly larger than the width of a skate blade 24 (see FIGS. 2 and 3) so that the blade cannot move laterally during the sharpening procedure. The depth of the wall is sufficient so that the blade is constrained to be substantially parallel to the slot walls 28 and 30.

Along the interior surface of each side wall 13 and 15 there is affixed a pair of opposing elongated rectangular honing stones 22. The gap between the stones is only slightly larger than the width of a skate blade 24 (see FIGS. 2 and 3). Side walls 13 and 15 are sufficiently flexible so that the gap between stones 22 can be reduced simply by a user squeezing the stones 22 together.

Figure 2:
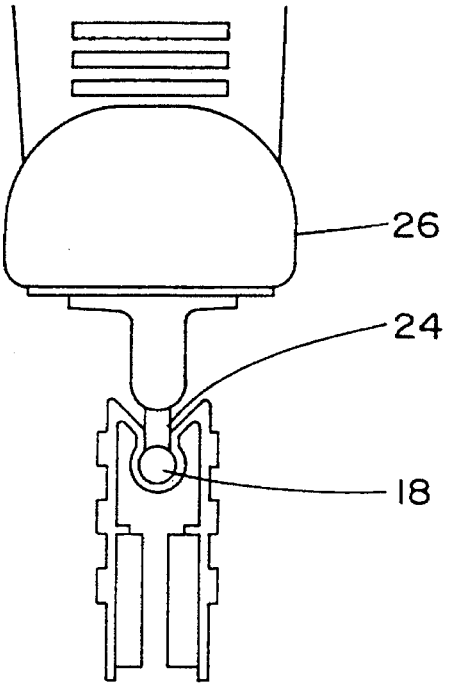
FIG. 2 is an end view of the sharpener showing an ice skate blade being sharpened.
Figure 3:
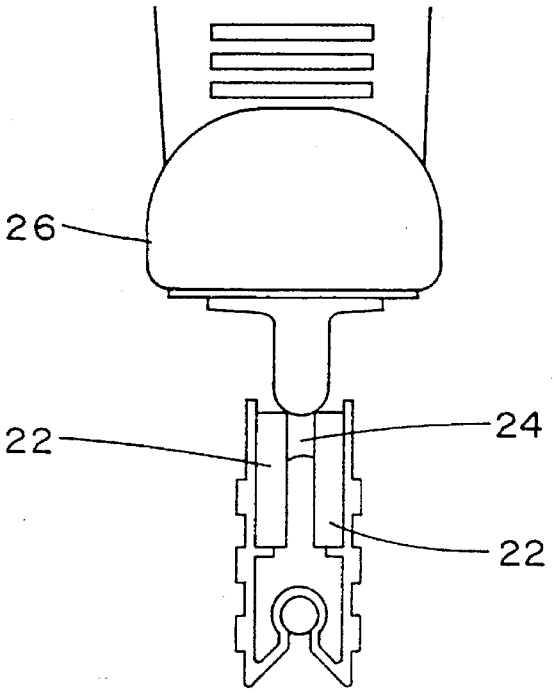
FIG. 3 is an end view of the sharpener showing an ice skate blade being deburred.

Referring to FIG. 2, a skate blade 24 is positioned within slot 19 against the convex surface of stone 18 and the holder 12 is moved longitudinally with a slight pressure being exerted against the blade 24. After several passes over the blade 24, the edges of the concave surface at the bottom of the blade 24 are sharpened. Any burrs left on the side of the blade 24 are removed by inserting the blade 24 between the stones 22 as shown in FIG. 3. Side walls 13 and 15 are squeezed together so as to exert a slight pressure on the sides of the blade 24 and the sharpener moved over the blade a few times, to thereby remove the burrs.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

We claim:

1. An ice skate blade sharpener, comprising an elongate body having a first elongated slot along one side edge with a honing stone affixed to a bottom thereof, presenting a convex, elongated, outwardly facing surface and side walls extending from said one side edge to another side edge of said body opposite said one side edge, said another side edge having a pair of elongated honing stones affixed to respective flexible side walls with planar parallel surfaces spaced apart and defining a second elongated slot slightly wider than the thickness of a skate blade, such that upon squeezing said side walls together said second elongated slot is narrowed so as to cause deburring of a sharpened skate blade inserted into said second slot and moved along the length thereof.

2. An ice skate blade sharpener according to claim 1, wherein said side walls are cantilevered from said one side edge.

3. An ice skate blade sharpener according to claim 1, wherein said first elongated slot is slightly wider than the width of a skate blade and sufficiently deep so as to constrain the blade to be substantially parallel to the sides of the slot.

4. An ice skate blade sharpener according to claim 1, wherein edge walls joining said side walls to said first slot are inclined towards a bottom of said slot from respective ones of said side walls.

5. An ice skate blade sharpener according to claim 1, wherein a bottom of said first slot is of circular cross section and snugly receives a honing stone also of circular cross section.

6. An ice skate blade sharpener according to claim 1, wherein said elongate body is an extruded length of aluminum.

7. An ice skate blade sharpener according to claim 1, wherein said honing stone is replaceable.

8. An ice skate blade sharpener, comprising an elongate body having a first elongated slot along one side edge for receiving at a bottom thereof a first honing stone having a convex outer surface, said body having parallel flexible side walls extending and cantilevered from said one side edge to another side edge of said body opposite said one side edge, said another side edge having a pair of elongated honing stones affixed to respective side walls with planar parallel surfaces spaced apart and defining a second elongated slot slightly wider than the thickness of a skate blade, such that upon squeezing said side walls together said second elongated slot is narrowed so as to cause deburring of a sharpened skate blade inserted into said second slot and moved along the length thereof.

9. An ice skate blade sharpener according to claim 8, wherein a bottom of said first slot is of circular cross section and snugly receives a honing stone also of circular cross section.

10. An ice skate blade sharpener according to claim 8, wherein edge walls joining said side walls to said first slot are inclined towards a bottom of said slot from respective ones of said side walls.

11. An ice skate blade sharpener according to claim 8, wherein the slot walls joining said edge walls to said slot are parallel and slightly wider than the width of a skate blade.

12. An ice skate blade sharpener according to claim 11, wherein said first slot is sufficiently deep so that a skate blade inserted between said edge walls is constrained to be substantially parallel to said edge walls.

* * * * *